US011013649B2

(12) United States Patent
Sonoda

(10) Patent No.: US 11,013,649 B2
(45) Date of Patent: May 25, 2021

(54) BATHROOM COMPATIBLE WHEELCHAIR

(71) Applicant: Sean Sonoda, Honolulu, HI (US)

(72) Inventor: Sean Sonoda, Honolulu, HI (US)

( * ) Notice: Subject to any disclaimer, the term of this patent is extended or adjusted under 35 U.S.C. 154(b) by 341 days.

(21) Appl. No.: 16/113,759

(22) Filed: Aug. 27, 2018

(65) Prior Publication Data

US 2020/0060904 A1 Feb. 27, 2020

(51) Int. Cl.
*A61G 5/10* (2006.01)

(52) U.S. Cl.
CPC ..... *A61G 5/1091* (2016.11); *A61G 5/1002* (2013.01); *A61G 5/1045* (2016.11)

(58) Field of Classification Search
CPC ... A61G 5/1091; A61G 5/1045; A61G 5/1002
See application file for complete search history.

(56) References Cited

U.S. PATENT DOCUMENTS

| | | | | |
|---|---|---|---|---|
| 4,067,409 | A * | 1/1978 | DiMatteo | A61G 5/045 180/6.5 |
| D339,315 | S | 9/1993 | Lindkvist | |
| 5,577,753 | A | 11/1996 | Pociask | |
| 6,209,901 | B1 | 4/2001 | Patel | |
| 6,547,265 | B1 * | 4/2003 | Enge | A61G 5/1002 135/66 |
| 9,383,751 | B2 * | 7/2016 | Lee | A61G 5/04 |
| 9,510,984 | B1 * | 12/2016 | MacKenzie | A47K 13/00 |
| 2009/0144891 | A1 | 6/2009 | Peng | |
| 2012/0090086 | A1 | 4/2012 | Melone | |
| 2013/0305447 | A1 | 11/2013 | Williams | |
| 2014/0042727 | A1 | 2/2014 | Musham | |

OTHER PUBLICATIONS

Amazon.com—DMI Rolling Shower and Commode Transport Chair with Wheels and Padded Seat for Handicap, Elderly, Injured and Disabled (https://www.amazon.com/DMI-Transport-Handicap-Disabled-Capacity/dp/B000EX61KQ?ref_=ast_sto_dp) (Year: 2006).*
DMI Shower Transport Chair with Rear Wheel Locks manual (Year: 2016).*

* cited by examiner

*Primary Examiner* — Minnah L Seoh
*Assistant Examiner* — Harold Eric Pahlck, III

(57) ABSTRACT

A bathroom compatible wheelchair assembly includes an Americans with Disabilities Act (ADA) compliant toilet of any conventional design. A wheelchair is provided that has a seat portion for bearing a disabled person. The seat portion has a height of at least 20.0 inches thereby facilitating the seat portion to be positioned over the ADA compliant toilet when the wheelchair is rolled over the ADA compliant toilet. Moreover, the seat portion has an opening extending therethrough and the opening is aligned with the ADA compliant toilet when the seat is positioned over the ADA compliant toilet for directing the disabled person's waste into the ADA compliant toilet. A control circuit is coupled to the wheelchair and a cover unit is movably coupled to the wheelchair. The cover unit is electrically coupled to the control circuit and the cover unit is positionable into a covering position to cover the opening. Thus, the cover unit can be sat upon by the disabled person. The cover unit is positionable in an exposing portion having the opening being exposed thereby facilitating the disabled user to relieve themselves without leaving the wheelchair.

6 Claims, 5 Drawing Sheets

BATHROOM COMPATIBLE WHEELCHAIR

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

(2) Description of Related Art Including Information Disclosed Under 37 CFR 1.97 and 1.98

The disclosure and prior art relates to wheelchair devices and more particularly pertains to a new wheelchair device for facilitating a disabled person to use a toilet without leaving a wheelchair.

BRIEF SUMMARY OF THE INVENTION

An embodiment of the disclosure meets the needs presented above by generally comprising an Americans with Disabilities Act (ADA) compliant toilet of any conventional design. A wheelchair is provided that has a seat portion for bearing a disabled person. The seat portion has a height of at least 20.0 inches thereby facilitating the seat portion to be positioned over the ADA compliant toilet when the wheelchair is rolled over the ADA compliant toilet. Moreover, the seat portion has an opening extending therethrough and the opening is aligned with the ADA compliant toilet when the seat is positioned over the ADA compliant toilet for directing the disabled person's waste into the ADA compliant toilet. A control circuit is coupled to the wheelchair and a cover unit is movably coupled to the wheelchair. The cover unit is electrically coupled to the control circuit and the cover unit is positionable into a covering position to cover the opening. Thus, the cover unit can be sat upon by the disabled person. The cover unit is positionable in an exposing portion having the opening being exposed thereby facilitating the disabled user to relieve themselves without leaving the wheelchair.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
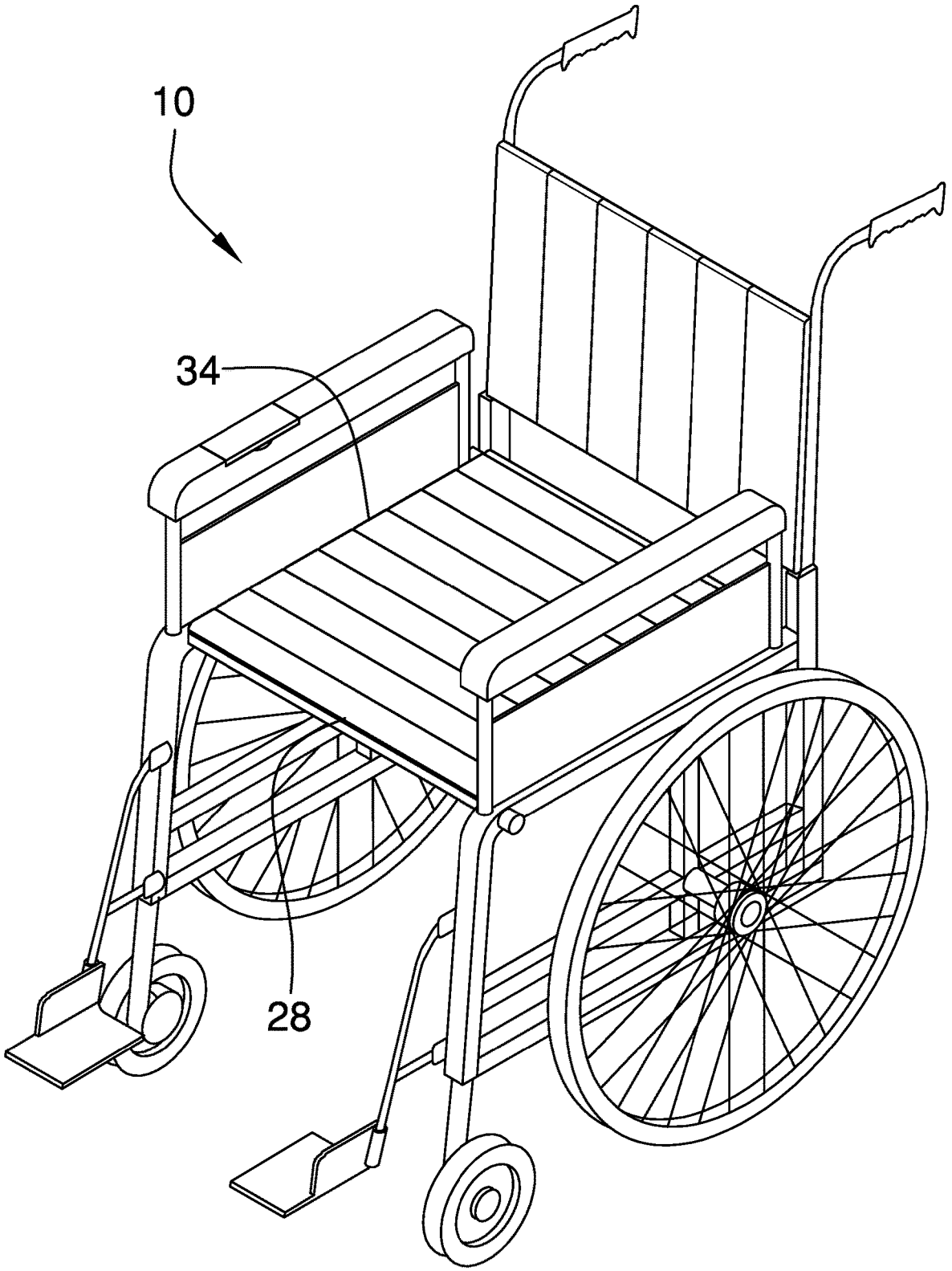
FIG. 1 is a top perspective view of a bathroom compatible wheelchair assembly according to an embodiment of the disclosure.
Figure 2:
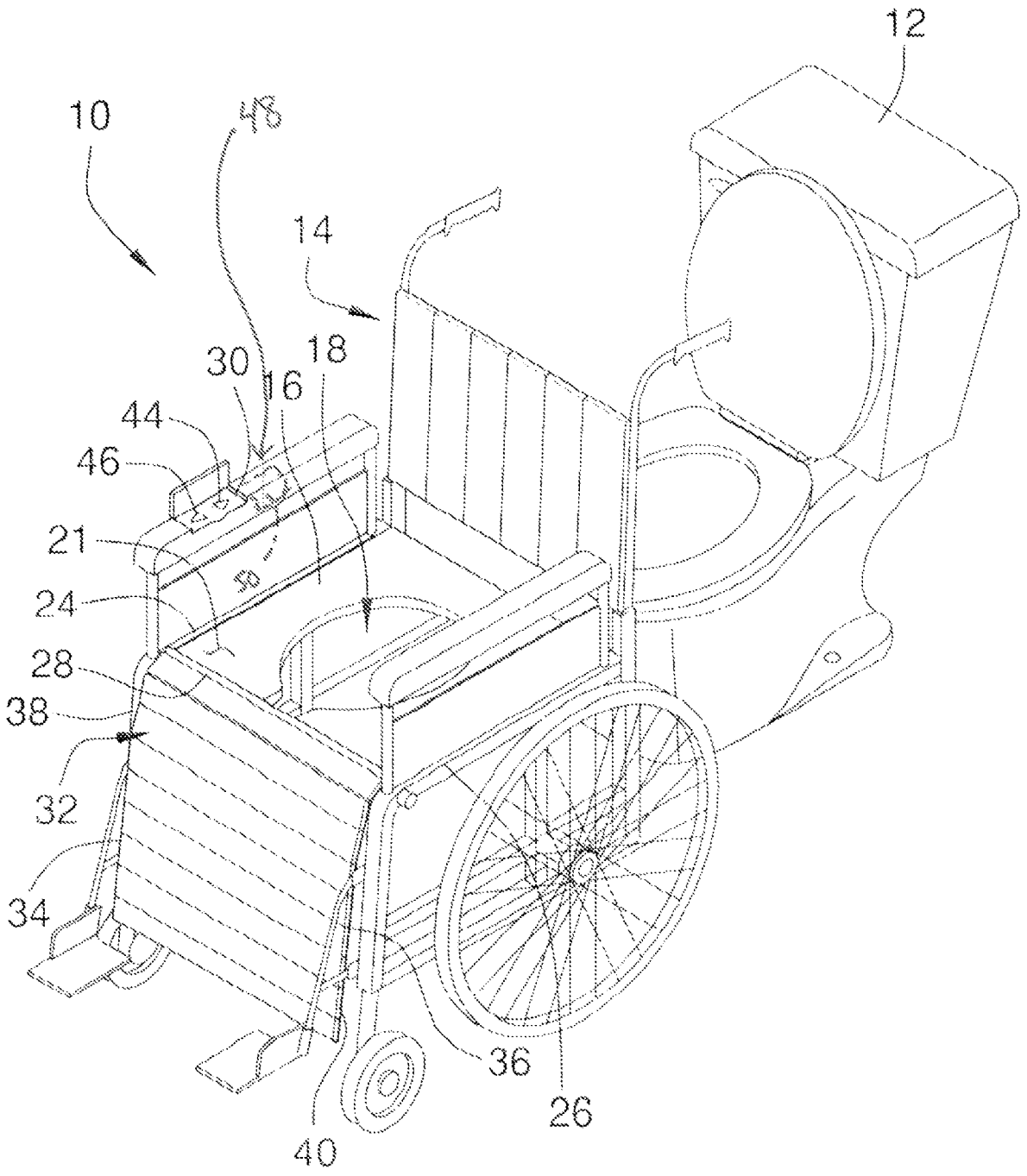
FIG. 2 is a perspective view of an embodiment of the disclosure showing a cover unit in an exposing position.
Figure 3:
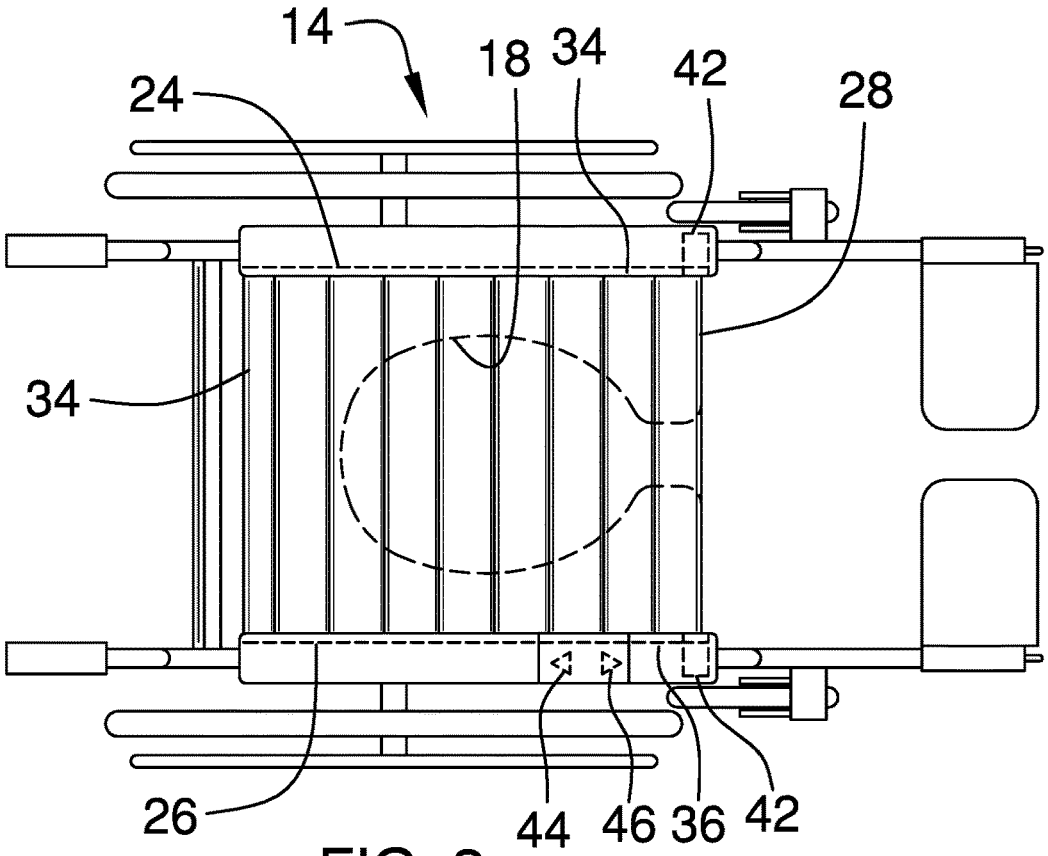
FIG. 3 is a top phantom view of an embodiment of the disclosure.
Figure 4:
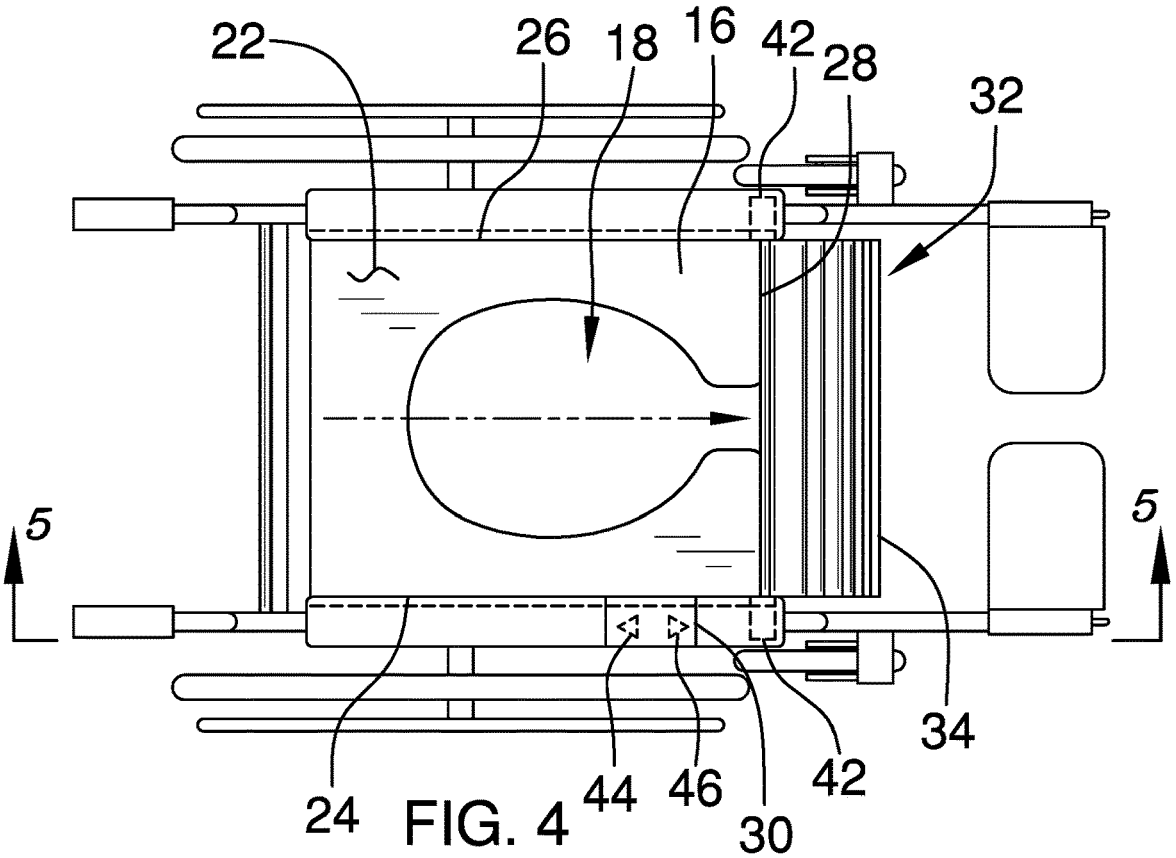
FIG. 4 is a bottom phantom view of an embodiment of the disclosure.
Figure 5:
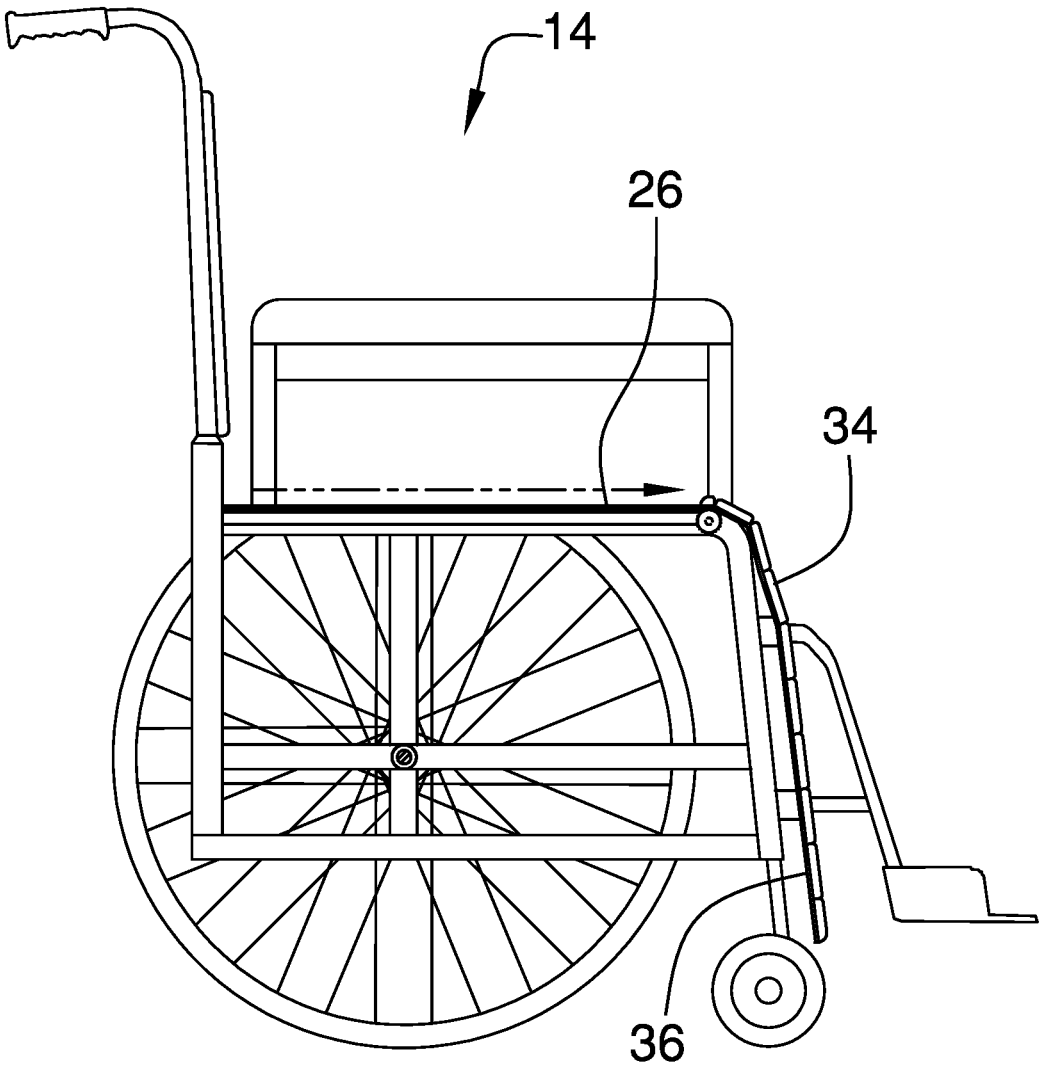
FIG. 5 is a right side view of an embodiment of the disclosure.
Figure 6:
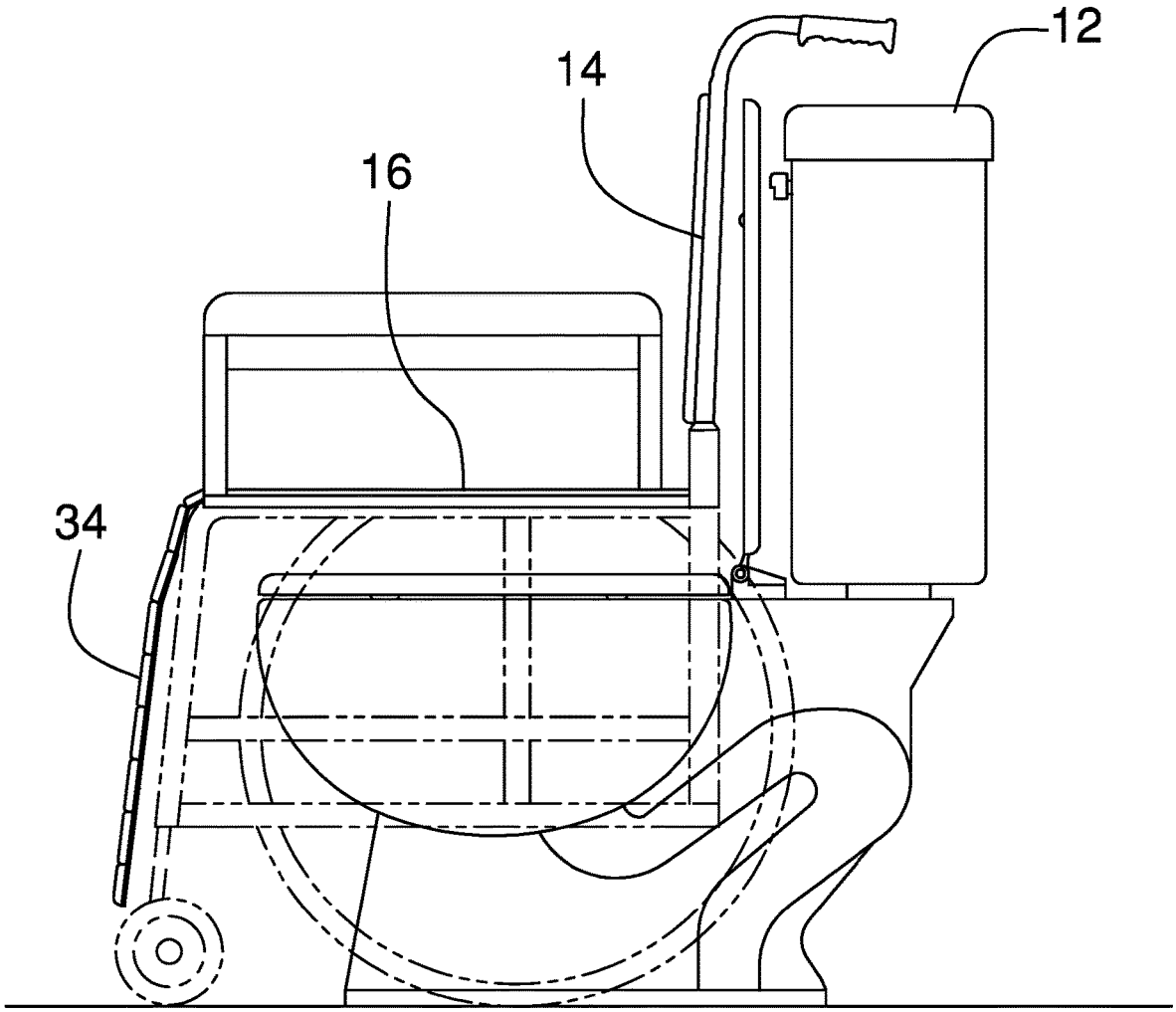
FIG. 6 is a right side phantom in-use view of an embodiment of the disclosure.

With reference now to the drawings, and in particular to FIGS. 1 through 6 thereof, a new wheelchair device embodying the principles and concepts of an embodiment of the disclosure and generally designated by the reference numeral 10 will be described.

As best illustrated in FIGS. 1 through 6, the bathroom compatible wheelchair assembly 10 generally comprises an Americans with Disabilities Act (ADA) compliant toilet 12. A wheelchair 14 is included that has a seat portion 16 for bearing a disabled person. The seat portion 16 has a height of at least 20.0 inches thereby facilitating the seat portion 16 to be positioned over the ADA compliant toilet 12 when the wheelchair 14 is rolled over the ADA compliant toilet 12. The seat portion 16 has an opening 18 extending therethrough and the opening 18 is aligned with the ADA compliant toilet 12 when the seat is positioned over the ADA compliant toilet 12. Thus, the opening 18 directs the disabled person's waste into the ADA compliant toilet 12 when the disabled person urinates or defecates.

The seat portion 16 has a top surface 21, a bottom surface 22, a first lateral surface 24, a second lateral surface 26 and a front surface 28, and the opening 18 extends through the top 20 and bottom 22 surfaces. A control circuit 30 is coupled to the wheelchair 14, a cover unit 32 is movably coupled to the wheelchair 14 and the cover unit 32 is electrically coupled to the control circuit 30. The cover unit 32 is positionable into a covering position having the cover unit 32 being positioned on the seat portion 16 and covering the opening 18. Thus, the disabled person sits on the cover unit 32 when the disabled person is sitting on the seat portion 16. The cover unit 32 is positionable in an exposing portion having the opening 18 being exposed thereby facilitating the disabled user to relieve themselves without leaving the wheelchair 14.

The cover unit 32 comprises a cushion 34 that has a bottom side 36, a first lateral side 38 and a second lateral side 40. The first lateral side 38 rollably engages the first lateral surface 24 of the seat portion 16 and the second lateral side 40 rollably engages the second lateral surface 26. The bottom side 36 rests on the top surface 21 of the seat portion 16 when the cover unit 32 is positioned in the covering position. Additionally, the cushion 34 hangs downwardly from the front surface 28 of the seat portion 16 when the cover unit 32 is positioned in the exposing position.

The cover unit 32 further includes a pair of motors 42 that are each coupled to the seat portion 16 and each of the motors 42 is positioned on a respective one of the first 24 and second 26 lateral surfaces of the seat portion 16. Each of the motors 42 is in mechanical communication with a respective one of the first 38 and second 40 lateral sides of the cushion 34, and each of the motors 42 is actuatable in a first direction and a second direction. Each of the motors 42 urges the cushion 34 rearwardly on the seat portion 16 to cover the opening 18 in the seat portion 16 when the motors 42 are actuated in the first direction. Alternatively, each of the motors 42 urges the cushion 34 forwardly on the seat portion 16 to expose the opening 18 when the motors 42 are actuated in the second direction. Each of the motors 42 may be an electric motor or the like and the cover unit 32 may include a pair of tracks, a plurality of enmeshing gears or any other mechanical means of converting the rotation of the motors 42 into linear motion with respect to the cushion 34.

A first button 44 is coupled to the wheelchair 14 and the first button 44 is electrically coupled to the control circuit 30. Each of the motors 42 is actuated in the first direction when the first button 44 is manipulated. A second button 46 is coupled to the wheelchair 14 and the second button 46 is electrically coupled to the control circuit 30. Each of the motors 42 is actuated in the second direction when the second button 46 is manipulated. A power supply 48 is coupled to the wheelchair 14, the power supply 48 is electrically coupled to the control circuit 30 and the power supply 48 comprises at least one battery 50.

In use, the first button 44 is manipulated to urge the cushion 34 rearwardly onto the seat portion 16 thereby covering the opening 18 in the seat portion 16. Thus, the disabled person can sit on the cushion 34 and employ the wheelchair 14 in conventional means. The wheelchair 14 is wheeled over the ADA compliant toilet 12 such that the opening 18 in the seat portion 16 is aligned with the ADA compliant toilet 12. The second button 46 is manipulated to urge the cushion 34 forwardly on the seat portion 16 thereby exposing the opening 18 in the seat portion 16. Thus, the disabled person can remain seated on the wheelchair 14 while the disabled person urinates or defecates.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A bathroom compatible wheelchair assembly being positionable over a toilet wherein said assembly is configured to facilitate an individual to use a toilet without leaving a wheelchair, said assembly comprising:

an Americans with Disabilities Act (ADA) compliant toilet;

a wheelchair having a seat portion for bearing a disabled person, said seat portion having a height of at least 20.0 inches thereby facilitating said seat portion to be positioned over said ADA compliant toilet when said wheelchair is rolled over said ADA compliant toilet, said seat portion having an opening extending therethrough, said opening being aligned with said ADA compliant toilet when said seat is positioned over said ADA compliant toilet wherein said opening is configured to direct the disabled person's waste into said ADA compliant toilet;

a control circuit being coupled to said wheelchair;

a cover unit being movably coupled to said wheelchair, said cover unit being electrically coupled to said control circuit, said cover unit being positionable into a covering position having said cover unit being positioned on said seat portion and covering said opening wherein said cover unit is configured to be sat upon by the disabled person, said cover unit being positionable in an exposing portion having said opening in being exposed thereby facilitating the disabled user to relieve themselves without leaving said wheelchair;

said seat portion having a top surface, a bottom surface, a first lateral surface, a second lateral surface and a front surface, said opening extending through said top and bottom surfaces; and said cover unit comprising a cushion having a bottom side, a first lateral side and a second lateral side, said first lateral side rollably engaging said first lateral surface of said seat portion, said second lateral side rollably engaging said second lateral surface, said bottom side resting on said top surface of said seat portion when said cover unit is positioned in said covering position, said cushion hanging downwardly from said front surface of said seat portion when said cover unit is positioned in said exposing position.

2. The assembly according to claim 1, further comprising a power supply being coupled to said wheelchair, said power supply being electrically coupled to said control circuit, said power supply comprising at least one battery.

3. A bathroom compatible wheelchair assembly being positionable over a toilet wherein said assembly is configured to facilitate an individual to use a toilet without leaving a wheelchair, said assembly comprising:

an Americans with Disabilities Act (ADA) compliant toilet;

a wheelchair having a seat portion for bearing a disabled person, said seat portion having a height of at least 20.0 inches thereby facilitating said seat portion to be positioned over said ADA compliant toilet when said wheelchair is rolled over said ADA compliant toilet, said seat portion having an opening extending therethrough, said opening being aligned with said ADA compliant toilet when said seat is positioned over said ADA compliant toilet wherein said opening is configured to direct the disabled person's waste into said ADA compliant toilet;

a control circuit being coupled to said wheelchair;

a cover unit being movably coupled to said wheelchair, said cover unit being electrically coupled to said control circuit, said cover unit being positionable into a covering position having said cover unit being positioned on said seat portion and covering said opening wherein said cover unit is configured to be sat upon by the disabled person, said cover unit being positionable in an exposing portion having said opening in being exposed thereby facilitating the disabled user to relieve themselves without leaving said wheelchair;

said seat portion having a first lateral surface and a second lateral surface;

said cushion has a first lateral side and a second lateral side; and a pair of motors, each of said motors being coupled to said seat portion, each of said motors being positioned on a respective one of said first and second lateral surfaces of said seat portion, each of said motors being in mechanical communication with a respective one of said first and second lateral sides of said cushion.

4. The assembly according to claim 3, wherein each of said motors is actuatable in a first direction and a second direction, each of said motors urging said cushion rearwardly on said seat portion to cover said opening in said seat portion when said motors are actuated in said first direction, each of said motors urging said cushion forwardly on said seat to expose said opening when said motors are actuated in said second direction.

5. The assembly according to claim 4, further comprising:

a first button being coupled to said wheelchair, said first button being electrically coupled to said control circuit, each of said motors being actuated in said first direction when said first button is manipulated; and a second button being coupled to said wheelchair, said second button being electrically coupled to said control circuit, each of said motors being actuated in said second direction when said second button is manipulated.

6. A bathroom compatible wheelchair assembly being positionable over a toilet wherein said assembly is configured to facilitate an individual to use a toilet without leaving a wheelchair, said assembly comprising:

an Americans with Disabilities Act (ADA) compliant toilet;

a wheelchair having a seat portion for bearing a disabled person, said seat portion having a height of at least 20.0 inches thereby facilitating said seat portion to be positioned over said ADA compliant toilet when said wheelchair is rolled over said ADA compliant toilet, said seat portion having an opening extending therethrough, said opening being aligned with said ADA compliant toilet when said seat is positioned over said ADA compliant toilet wherein said opening is configured to direct the disabled person's waste into said ADA compliant toilet, said seat portion having a top surface, a bottom surface, a first lateral surface, a second lateral surface and a front surface, said opening extending through said top and bottom surfaces;

a control circuit being coupled to said wheelchair; and a cover unit being movably coupled to said wheelchair, said cover unit being electrically coupled to said control circuit, said cover unit being positionable into a covering position having said cover unit being positioned on said seat portion and covering said opening wherein said cover unit is configured to be sat upon by the disabled person, said cover unit being positionable in an exposing portion having said opening in being exposed thereby facilitating the disabled user to relieve themselves without leaving said wheelchair, said cover unit comprising:

a cushion having a bottom side, a first lateral side and a second lateral side, said first lateral side rollably engaging said first lateral surface of said seat portion, said second lateral side rollably engaging said second lateral surface, said bottom side resting on said top surface of said seat portion when said cover unit is positioned in said covering position, said cushion hanging downwardly from said front surface of said seat portion when said cover unit is positioned in said exposing position;

a pair of motors, each of said motors being coupled to said seat portion, each of said motors being positioned on a respective one of said first and second lateral surfaces of said seat portion, each of said motors being in mechanical communication with a respective one of said first and second lateral sides of said cushion, each of said motors being actuatable in a first direction and a second direction, each of said motors urging said cushion rearwardly on said seat portion to cover said opening in said seat portion when said motors are actuated in said first direction, each of said motors urging said cushion forwardly on said seat to expose said opening when said motors are actuated in said second direction;

a first button being coupled to said wheelchair, said first button being electrically coupled to said control circuit, each of said motors being actuated in said first direction when said first button is manipulated;

a second button being coupled to said wheelchair, said second button being electrically coupled to said control circuit, each of said motors being actuated in said second direction when said second button is manipulated; and a power supply being coupled to said wheelchair, said power supply being electrically coupled to said control circuit, said power supply comprising at least one battery.

* * * * *